US009011077B2

(12) United States Patent
Vitt et al.

(10) Patent No.: US 9,011,077 B2
(45) Date of Patent: Apr. 21, 2015

(54) COOLED AIRFOIL IN A TURBINE ENGINE

(75) Inventors: Paul H. Vitt, Liberty Township, OH (US); David A. Kemp, West Chester, OH (US); Ching-Pang Lee, Cincinnati, OH (US); John J. Marra, Winter Springs, FL (US)

(73) Assignee: Siemens Energy, Inc., Orlando, FL (US)

( * ) Notice: Subject to any disclaimer, the term of this patent is extended or adjusted under 35 U.S.C. 154(b) by 978 days.

(21) Appl. No.: 13/090,294

(22) Filed: Apr. 20, 2011

(65) Prior Publication Data

US 2012/0269647 A1 Oct. 25, 2012

(51) Int. Cl.
*F01D 5/18* (2006.01)

(52) U.S. Cl.
CPC ..... *F01D 5/186* (2013.01); *F01D 5/188* (2013.01); *F05D 2250/30* (2013.01); *F05D 2260/221* (2013.01); *F05D 2260/941* (2013.01)

(58) Field of Classification Search
CPC ..... F01D 5/18; F01D 5/187; F01D 5/188; F01D 5/189
USPC ..... 415/115; 416/92, 96 R, 96 A, 97 R
See application file for complete search history.

(56) References Cited

U.S. PATENT DOCUMENTS 3,767,322 A 10/1973 Durgin et al.
4,118,146 A 10/1978 Dierberger
4,168,938 A * 9/1979 Dodd ..... 416/97 R
4,183,716 A 1/1980 Takahara et al.
4,500,258 A 2/1985 Dodd et al.
5,120,192 A * 6/1992 Ohtomo et al. ..... 415/115
5,193,975 A * 3/1993 Bird et al. ..... 415/115
5,375,972 A 12/1994 Gray
5,667,359 A 9/1997 Huber et al.
5,820,337 A 10/1998 Jackson et al.
5,931,638 A 8/1999 Krause et al.
5,993,156 A 11/1999 Bailly et al.
6,036,441 A 3/2000 Manning et al.
6,174,133 B1 1/2001 Bunker
6,254,334 B1 7/2001 LaFleur
6,379,118 B2 4/2002 Lutum et al.
6,402,470 B1 6/2002 Kvasnak et al.
6,428,273 B1 * 8/2002 Keith et al. ..... 416/97 R
6,478,535 B1 11/2002 Chung et al.

(Continued)

FOREIGN PATENT DOCUMENTS

EP 0392664 A2 10/1990
EP 0785339 A1 7/1997

(Continued)

*Primary Examiner* — Dwayne J White
*Assistant Examiner* — Su Htay

(57) ABSTRACT

An airfoil in a gas turbine engine includes an outer wall and an inner wall. The outer wall includes a leading edge, a trailing edge opposed from the leading edge in a chordal direction, a pressure side, and a suction side. The inner wall is coupled to the outer wall at a single chordal location and includes portions spaced from the pressure and suction sides of the outer wall so as to form first and second gaps between the inner wall and the respective pressure and suction sides. The inner wall defines a chamber therein and includes openings that provide fluid communication between the respective gaps and the chamber. The gaps receive cooling fluid that provides cooling to the outer wall as it flows through the gaps. The cooling fluid, after traversing at least substantial portions of the gaps, passes into the chamber through the openings in the inner wall.

17 Claims, 4 Drawing Sheets

(56) References Cited

U.S. PATENT DOCUMENTS

| | | | | |
|---|---|---|---|---|
| 6,572,335 | B2 * | 6/2003 | Kuwabara et al. | 416/97 R |
| 6,607,355 | B2 | 8/2003 | Cunha et al. | |
| 6,769,866 | B1 | 8/2004 | Kannefass et al. | |
| 6,929,445 | B2 * | 8/2005 | Zatorski et al. | 415/115 |
| 6,955,523 | B2 | 10/2005 | McClelland | |
| 7,390,168 | B2 | 6/2008 | Liang | |
| 7,789,625 | B2 | 9/2010 | Liang | |
| 8,057,183 | B1 * | 11/2011 | Liang | 416/97 R |
| 8,297,927 | B1 * | 10/2012 | Liang | 416/97 R |
| 2001/0018021 | A1 | 8/2001 | Anding et al. | |
| 2005/0025623 | A1 | 2/2005 | Botrel et al. | |
| 2005/0031452 | A1 | 2/2005 | Liang | |
| 2008/0056888 | A1 * | 3/2008 | Somanath et al. | 415/142 |
| 2008/0240919 | A1 | 10/2008 | Liang | |
| 2008/0279696 | A1 | 11/2008 | Liang | |
| 2008/0286104 | A1 | 11/2008 | Liang | |
| 2010/0104419 | A1 * | 4/2010 | Liang | 415/115 |

FOREIGN PATENT DOCUMENTS

| | | | |
|---|---|---|---|
| EP | 1106781 | A1 | 6/2001 |
| FR | 2221020 | A5 | 10/1974 |
| GB | 1388260 | A | 3/1975 |
| JP | 59122704 | A | 7/1984 |
| WO | 2008133758 | A2 | 11/2008 |

* cited by examiner

COOLED AIRFOIL IN A TURBINE ENGINE

This invention was made with U.S. Government support under Contract Number DE-FC26-05NT42644 awarded by the U.S. Department of Energy. The U.S. Government has certain rights to this invention.

FIELD OF THE INVENTION

The present invention relates to a cooling system in a turbine engine, and more particularly, to a cooling system for use in an airfoil assembly in a turbine engine.

BACKGROUND OF THE INVENTION

In gas turbine engines, compressed air discharged from a compressor section and fuel introduced from a source of fuel are mixed together and burned in a combustion section, creating combustion products defining a high temperature working gas. The working gas is directed through a hot gas path in a turbine section, where the working gas expands to provide rotation of a turbine rotor. The turbine rotor may be linked to an electric generator, wherein the rotation of the turbine rotor can be used to produce electricity in the generator.

In view of high pressure ratios and high engine firing temperatures implemented in modern engines, certain components, such as airfoils, e.g., stationary vanes and rotating blades within the turbine section, must be cooled with cooling fluid, such as compressor discharge air, to prevent overheating of the components.

SUMMARY OF THE INVENTION

In accordance with a first aspect of the present invention, an airfoil is provided in a gas turbine engine. The airfoil comprises an outer wall, a first inner wall, and a second inner wall. The outer wall includes a leading edge, a trailing edge, a pressure side, and a suction side. The first inner wall is coupled to the outer wall toward the leading edge. The first inner wall includes portions spaced from the pressure and suction sides of the outer wall so as to form first and second leading edge gaps between the first inner wall and the respective pressure and suction sides. The first inner wall defines a leading edge chamber therein and includes openings that provide fluid communication between the respective leading edge gaps and the leading edge chamber. The leading edge gaps receive cooling fluid that provides cooling to the outer wall as it flows through the leading edge gaps. The cooling fluid, after traversing at least substantial portions of the leading edge gaps, passes into the leading edge chamber through the openings in the first inner wall. The second inner wall is coupled to the outer wall toward the trailing edge. The second inner wall includes portions spaced from the pressure and suction sides of the outer wall so as to form first and second trailing edge gaps between the second inner wall and the respective pressure and suction sides. The second inner wall defines a trailing edge chamber therein and includes openings that provide fluid communication between the respective trailing edge gaps and the trailing edge chamber. The trailing edge gaps receive cooling fluid that provides cooling to the outer wall as it flows through the trailing edge gaps. The cooling fluid, after traversing at least substantial portions of the trailing edge gaps, passes into the trailing edge chamber through the openings in the second inner wall.

In accordance with a second aspect of the present invention, an airfoil is provided in a gas turbine engine. The airfoil comprises an outer wall and an inner wall. The outer wall includes a leading edge, a trailing edge opposed from the leading edge in a chordal direction, a pressure side, and a suction side. The inner wall is coupled to the outer wall at a single chordal location and includes portions spaced from the pressure and suction sides of the outer wall so as to form first and second gaps between the inner wall and the respective pressure and suction sides. The inner wall defines a chamber therein and includes openings that provide fluid communication between the respective gaps and the chamber. The gaps receive cooling fluid that provides cooling to the outer wall as it flows through the gaps. The cooling fluid, after traversing at least substantial portions of the gaps, passes into the chamber through the openings in the inner wall.

In accordance with a third aspect of the present invention, an airfoil assembly is provided in a gas turbine engine. The airfoil assembly comprises an inner shroud, an outer shroud spaced from the inner shroud in a radial direction of the engine, and an airfoil between the inner and outer shrouds. The airfoil comprises an outer wall, a first inner wall, and a second inner wall. The outer wall is coupled to the inner shroud and to the outer shroud and includes a leading edge, a trailing edge opposed from the leading edge in a chordal direction, a pressure side, and a suction side. The first inner wall is coupled to the inner shroud and to the outer shroud and is coupled to the outer wall at a single chordal location toward the leading edge. The first inner wall includes portions spaced from the pressure and suction sides of the outer wall so as to form first and second leading edge gaps between the first inner wall and the respective pressure and suction sides. The leading edge gaps receive cooling fluid that provides cooling to the outer wall as it flows through the leading edge gaps. The second inner wall is coupled to the inner shroud and to the outer shroud and is coupled to the outer wall at a single chordal location toward the trailing edge. The second inner wall includes portions spaced from the pressure and suction sides of the outer wall so as to form first and second trailing edge gaps between the second inner wall and the respective pressure and suction sides. The trailing edge gaps receive cooling fluid that provides cooling to the outer wall as it flows through the trailing edge gaps.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
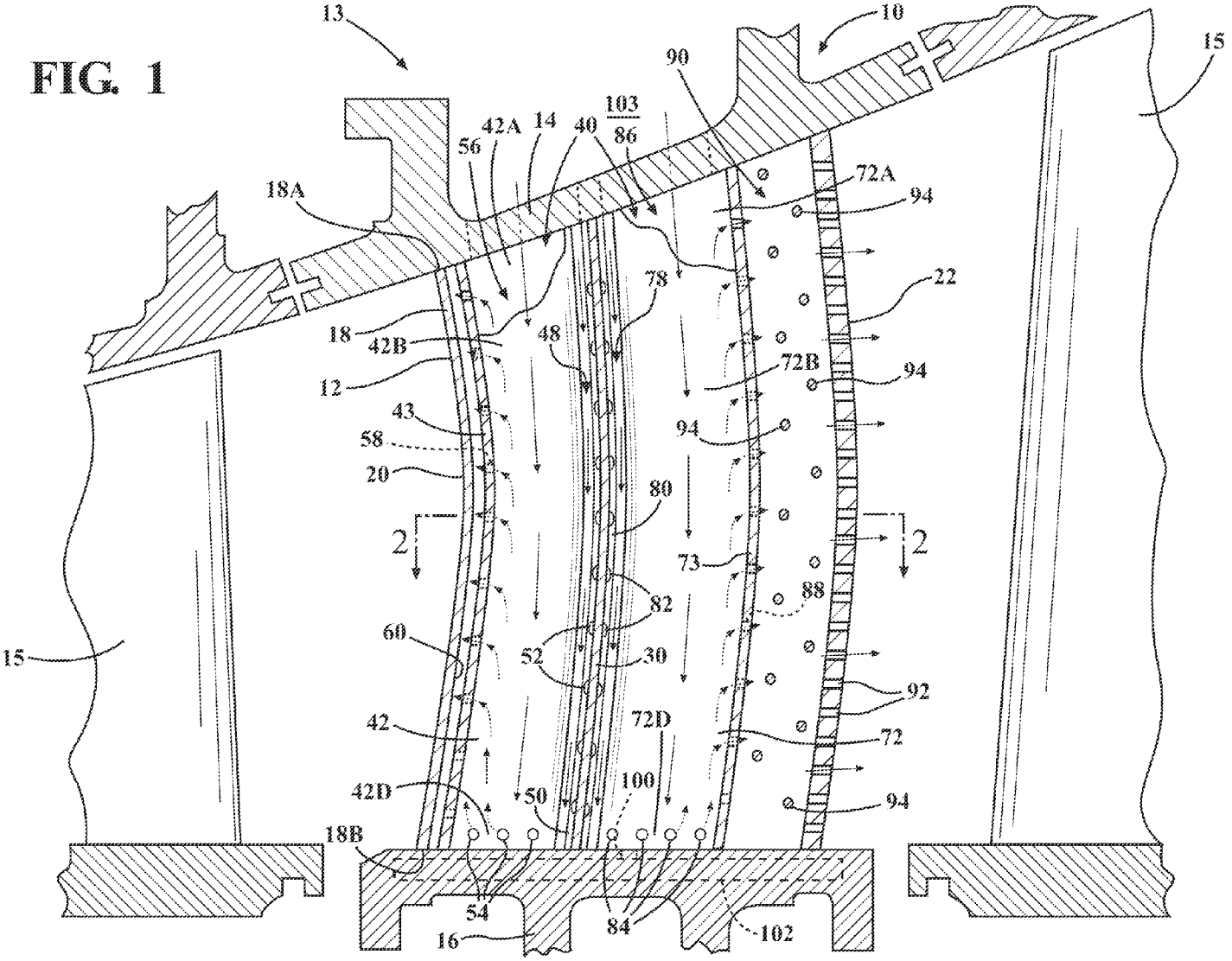
FIG. 1 is a side cut away view of an airfoil assembly to be cooled in a gas turbine engine according to an embodiment of the invention, wherein a suction side of a vane of the airfoil assembly has been removed.

Referring now to FIG. 1, an airfoil assembly 10 constructed in accordance with a first embodiment of the present invention is illustrated. In this embodiment, the airfoil assembly 10 is a vane assembly comprising an airfoil, i.e., a stationary vane 12. The airfoil assembly 10 is for use in a turbine section 13 of a gas turbine engine, although it is understood that the cooling concepts disclosed herein could be used in combination with a rotating blade.

As will be apparent to those skilled in the art, the gas turbine engine includes a compressor section (not shown), a combustor section (not shown), and the turbine section 13. The compressor section compresses ambient air. The combustor section combines the compressed air from the compressor section with a fuel and ignites the mixture creating combustion products defining a high temperature working gas. The high temperature working gas travels to the turbine section 13, where the working gas passes through one or more turbine stages, each turbine stage comprising a row of stationary vanes and a row of rotating blades. It is contemplated that the vane assembly illustrated in FIG. 1 may define the vane configuration for a second row of vane assemblies in the turbine section 13.

The stationary vanes and rotating blades in the turbine section 13 are exposed to the high temperature working gas as the working gas passes through the turbine section 13. To cool the vanes and blades, cooling air from the compressor section may be provided thereto, as will be described herein.

As shown in FIG. 1, the airfoil assembly 10 comprises the vane 12, an outer shroud 14, and an inner shroud 16, wherein the vane 12 is affixed between the outer and inner shrouds 14, 16. The vane comprises an outer wall 18 (see also FIG. 2) that is affixed at a radially outer edge 18A thereof to the outer shroud 14 and at a radially inner edge 18B thereof to the inner shroud 16.

Figure 2:
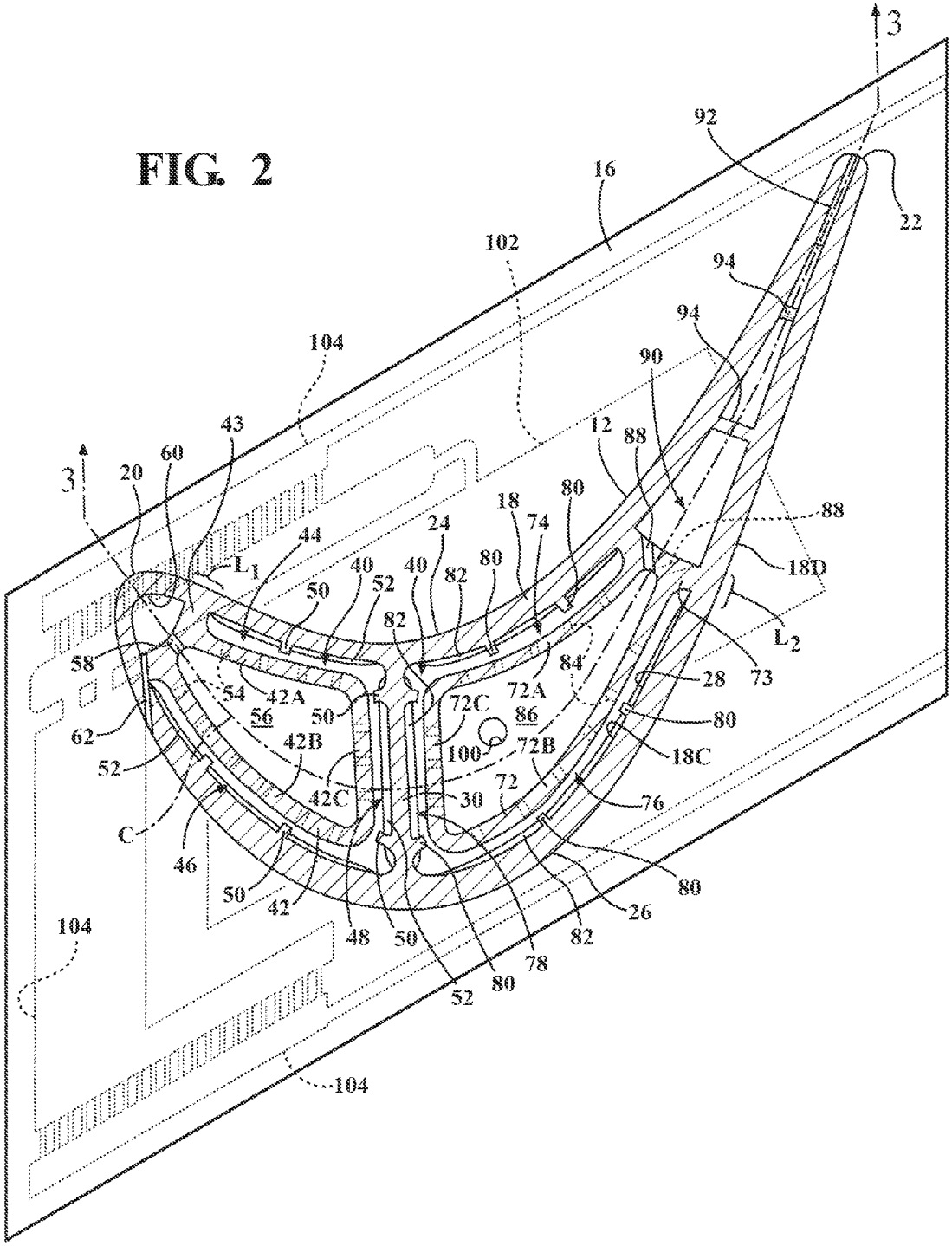
FIG. 2 is cross sectional view of the airfoil assembly of claim 1 taken along line 2-2 in FIG. 1.

Referring to FIG. 2, the outer wall 18 includes a leading edge 20, a trailing edge 22 spaced from the leading edge 20 in a chordal direction C, a concave-shaped pressure side 24, and a convex-shaped suction side 26. It is noted that the suction side 26 of the vane 12 illustrated in FIG. 1 has been removed to show the internal structures within the vane 12, i.e., FIG. 1 illustrates a view looking at an outer surface of a second portion 42B of a first inner wall 42 and an outer surface of a second portion 72B of a second inner wall 72, each of which will be described herein. An inner surface 18C of the outer wall 18 defines a hollow interior portion 28 extending between the pressure and suction sides 24, 26 from the leading edge 20 to the trailing edge 22. A rigid spanning structure 30 extends within the hollow interior portion 28 from the pressure side 24 to the suction side 26 to provide structural rigidity for the vane 12. The spanning structure 30 may be formed integrally with the outer wall 18. A conventional thermal barrier coating (not shown) may be provided on an outer surface 18D of the outer wall 18 to increase the heat resistance of the vane 12, as will be apparent to those skilled in the art.

In accordance with the present invention, the airfoil assembly 10 is provided with a cooling system 40 for effecting cooling of the airfoil assembly 10. As noted above, while the description below is directed to a cooling system 40 for use with a vane assembly, it is contemplated that the concepts of the cooling system 40 of the present invention could be incorporated into a blade assembly 15.

As shown in FIGS. 1 and 2, the cooling system 40 includes the first inner wall 42 located in the hollow interior portion 28 toward the leading edge 20. The first inner wall 42 is preferably cast integrally with the outer wall 18 and is affixed to the outer and inner shrouds 14, 16, see FIG. 1. As shown in FIG. 2, the first inner wall 42 is only affixed to the outer wall 18 at a single chordal location $L_1$, which location $L_1$ is near the leading edge 20 of the outer wall 18 in the illustrated embodiment but may be located elsewhere as desired. The affixation of the first inner wall 42 to the outer wall 18 at the location $L_1$ may be effected by a rib 43 located near the leading edge 20 of the outer wall 18, wherein the rib 43 may span between the pressure and suction sides 24, 26 of the outer wall 18. Affixing the first inner wall 42 to the outer wall 18 in such a single chordal location $L_1$ is preferred for thermal growth purposes, as will be explained herein.

Referring still to FIG. 2, a first portion 42A of the first inner wall 42 is spaced from the pressure side 24 of the outer wall 18 such that a first leading edge gap 44 is formed therebetween. The second portion 42B of the first inner wall 42 is spaced from the suction side 26 of the outer wall 18 such that a second leading edge gap 46 is formed therebetween. A third portion 42C of the first inner wall 42 is spaced from the spanning structure 30 such that a third leading edge gap 48 is formed therebetween. As will be described herein, cooling fluid, such as compressor discharge air, is introduced into the cooling system 40 from the outer shroud 14 into the leading edge gaps 44, 46, 48.

In the embodiment shown, spacer members 50 are located between the first inner wall 42 and each of the outer wall 18 and the spanning structure 30. The spacer members 50 extend substantially the entire radial lengths of the outer wall and the spanning structure 30. The spacer members 50 provide spacing between the first inner wall 42 and each of the outer wall 18 and the spanning structure 30 but are only affixed to either the first inner wall 42 or the outer wall 18 and the spanning structure 30 so as to maintain sufficient flow areas in the leading edge gaps 44, 46, 48, while permitting relative movement between the first inner wall 42 and each of the outer wall 18 and the spanning structure 30.

In the preferred embodiment, turbulator ribs 52 (see FIG. 2) are formed on or are otherwise affixed to the inner surface 18C of the outer wall 18 and to the spanning structure 30. The turbulator ribs 52 extend into the leading edge gaps 44, 46, 48 and effect a turbulation of the cooling fluid flowing through the leading edge gaps 44, 46, 48 so as to increase cooling provided to the outer wall 18, as will be described herein.

Referring to FIG. 1, a radially inner portion 42D of the first inner wall 42 includes a plurality of openings 54 therein. The openings 54 provide fluid communication between the leading edge gaps 44, 46, 48 and a leading edge chamber 56 defined by the first inner wall 42, see FIG. 2. Preferably, the first inner wall 42 includes no other openings for receiving cooling fluid from the leading edge gaps 44, 46, 48 other than the openings 54 at the radially inner portion 42D thereof, such that all of the cooling fluid flowing through this portion of the cooling system 40 must traverse entire radial lengths of the leading edge gaps 44, 46, 48 before passing into the leading edge chamber 56. Further, the outer wall 18 preferably does not have any openings therein in fluid communication with the leading edge gaps 44, 46, 48, such that cooling fluid cannot escape out of the leading edge gaps 44, 46, 48 through the outer wall 18.

Referring to FIG. 2, the first inner wall 42 further includes a plurality of exit openings 58 (one shown in FIG. 2) therein. The exit openings 58 may be located along substantially the entire radial length of the first inner wall 42 toward the leading edge 20 of the outer wall 18 at a location where the first and second portions 42A, 42B of the first inner wall 42 meet. The exit openings 58 provide passageways for cooling fluid to exit the leading edge chamber 56 and to enter a leading edge channel 60, which leading edge channel 60 is located between the first inner wall 42 and the leading edge 20 and is at least partially defined by the rib 43, see also FIG. 1. The outer wall 18 comprises a plurality of exit passages 62, which are preferably located in the suction side 26 of the outer wall 18. The exit passages 62 allow the cooling fluid to exit the cooling system 40 wherein the cooling fluid exits the leading edge channel 60 and is mixed with the hot working gases passing through the turbine section 13.

As shown in FIGS. 1 and 2, the cooling system 40 includes the second inner wall 72 located in the hollow interior portion 28 toward the trailing edge 22 of the outer wall 18. The second inner wall 72 is preferably cast integrally with the outer wall 18 and is affixed to the outer and inner shrouds 14, 16, see FIG. 1. As shown in FIG. 2, the second inner wall 72 is only affixed to the outer wall 18 at a single chordal location $L_2$, which location $L_2$ is toward the trailing edge 22 of the outer wall 18 in the illustrated embodiment but may be located elsewhere as desired. The affixation of the second inner wall 72 to the outer wall 18 at the location $L_2$ may be effected by a rib 73 located toward the trailing edge 22 of the outer wall 18, wherein the rib 73 may span between the pressure and suction sides 24, 26 of the outer wall 18. Affixing the second inner wall 72 to the outer wall 18 in such a single chordal location $L_2$ is preferred for thermal growth purposes, as will be explained herein.

Referring still to FIG. 2, a first portion 72A of the second inner wall 72 is spaced from the pressure side 24 of the outer wall 18 such that a first trailing edge gap 74 is formed therebetween. The second portion 72B of the second inner wall 72 is spaced from the suction side 26 of the outer wall 18 such that a second trailing edge gap 76 is formed therebetween. A third portion 72C of the second inner wall 72 is spaced from the spanning structure 30 such that a third trailing edge gap 78 is formed therebetween. As will be described herein, cooling fluid is introduced into the cooling system 40 from the outer shroud 14 into the trailing edge gaps 74, 76, 78.

In the embodiment shown, spacer members 80 are located between the second inner wall 72 and each of the outer wall 18 and the spanning structure 30. The spacer members 80 extend substantially the entire radial lengths of the outer wall and the spanning structure 30. The spacer members 80 provide spacing between the second inner wall 72 and each of the outer wall 18 and the spanning structure 30 but are only affixed to either the second inner wall 72 or the outer wall 18 and the spanning structure 30 so as to maintain sufficient flow areas in the trailing edge gaps 74, 76, 78, while permitting relative movement between the second inner wall 72 and each of the outer wall 18 and the spanning structure 30.

In the preferred embodiment, turbulator ribs 82 (see FIG. 2) are formed on or are otherwise affixed to the inner surface 18C of the outer wall 18 and to the spanning structure 30. The turbulator ribs 82 extend into the trailing edge gaps 74, 76, 78 and effect a turbulation of the cooling fluid flowing through the trailing edge gaps 74, 76, 78 so as to increase cooling provided to the outer wall 18, as will be described herein.

Referring to FIG. 1, a radially inner portion 72D of the second inner wall 72 includes a plurality of openings 84 therein. The openings 84 provide fluid communication between the trailing edge gaps 74, 76, 78 and a trailing edge chamber 86 defined by the second inner wall 72, see FIG. 2. Preferably, the second inner wall 72 includes no other openings for receiving cooling fluid from the trailing edge gaps 74, 76, 78 other than the openings 84 at the radially inner portion 72D thereof, such that all of the cooling fluid flowing through this portion of the cooling system 40 must traverse entire radial lengths of the trailing edge gaps 74, 76, 78 before passing into the trailing edge chamber 86. Further, the outer wall 18 preferably does not have any openings therein in fluid communication with the trailing edge gaps 74, 76, 78, such that cooling fluid cannot escape out of the trailing edge gaps 74, 76, 78 through the outer wall 18.

Referring to FIG. 2, the second inner wall 72 further includes a plurality of exit openings 88 therein. The exit openings 88 may be located along substantially the entire radial length of the second inner wall 72 toward the trailing edge 22 of the outer wall 18 at a location where the first and second portions 72A, 72B of the second inner wall 72 meet. Further, the exit openings 88 may extend in an alternating pattern between extending toward the pressure side 24 and the suction side 26 of the outer wall 18, as illustrated in FIG. 2. The exit openings 88 provide passageways for cooling fluid to exit the trailing edge chamber 86 and to enter a trailing edge channel 90, which trailing edge channel 90 is located between the second inner wall 72 and the trailing edge 22 and is at least partially defined by the rib 73. The outer wall 18 comprises a plurality of exit passages 92, which are preferably located at the trailing edge 22 of the outer wall 18. The exit passages 92 allow the cooling fluid to exit the cooling system 40, wherein the cooling fluid is mixed with the hot working gases passing through the turbine section 13. As shown in FIGS. 1 and 2, pin fins 94 may extend in the trailing edge channel 90 from the pressure side 24 to the suction side 26 to provide structural rigidity for the outer wall 18 and for heat transfer purposes, as will be apparent to those skilled in the art.

As shown in FIG. 2, the inner shroud 16 includes an opening 100 formed therein in communication with the trailing edge chamber 86. The opening 100 allows cooling fluid to pass from the trailing edge chamber 86 into a cavity 102 formed in the inner shroud 16. Cooling fluid that passes into the cavity 102 can be used to cool structure in the inner shroud 16 located along a cooling circuit 104 formed in the inner shroud 16. The configuration of the cooling circuit 104 illustrated in FIG. 2 is exemplary and could comprise any configuration.

Figure 3:
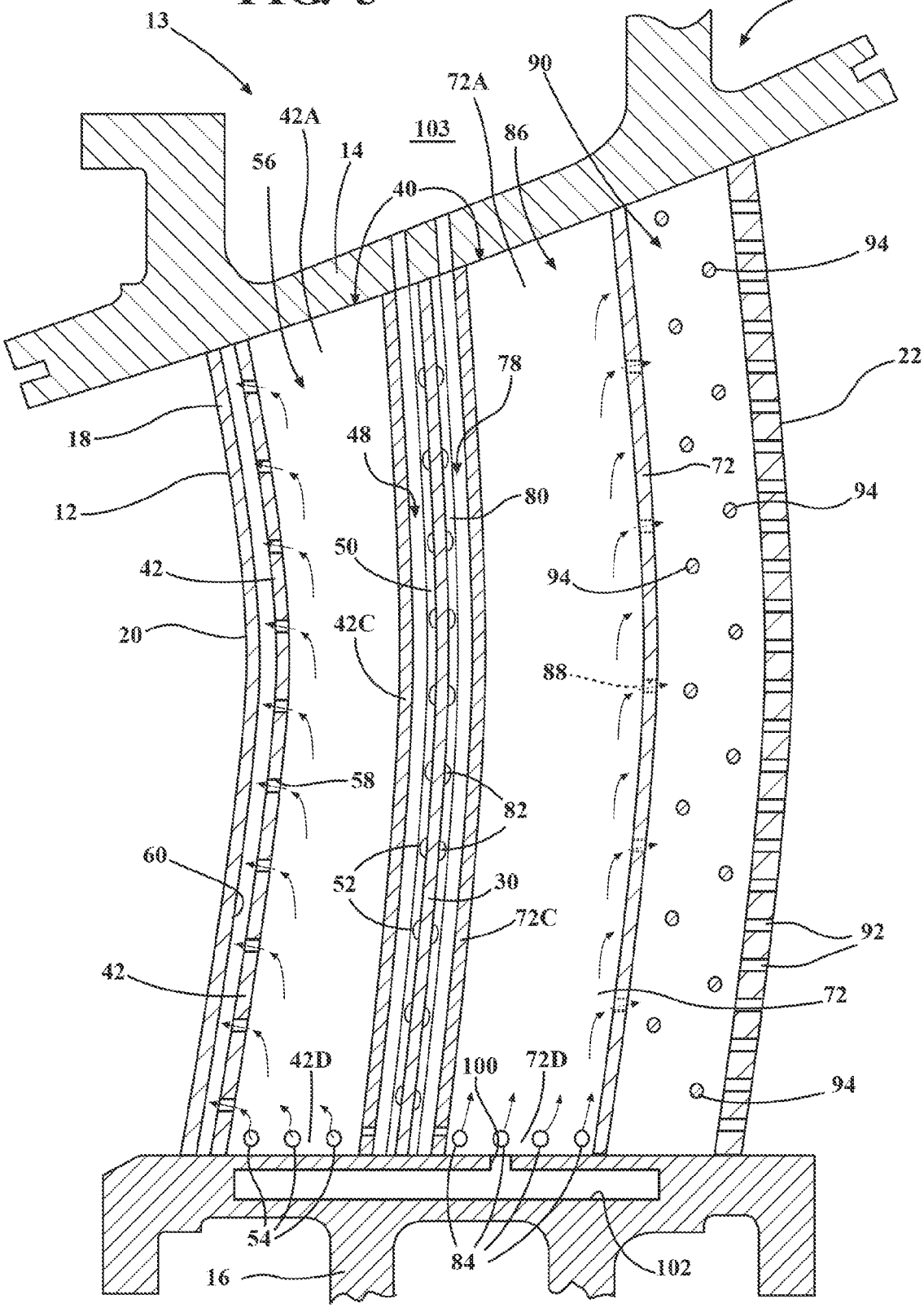
FIG. 3 is a cross sectional view taken along line 3-3 in FIG. 2.

During operation, cooling fluid, such as compressor discharge air, is provided to a plenum 103 associated with the outer shroud 14 in any known manner, as will be apparent to those skilled in the art. The cooling fluid passes into the leading and trailing edge gaps 44, 46, 48, 74, 76, 78 from the plenum 103, see FIGS. 1 and 3. As the cooling fluid flows radially inwardly through the gaps 44, 46, 48, 74, 76, 78, it is guided by the spacer members 50, 80 and provides cooling to the outer wall 18, which is heated during operation of the engine by the hot working gases flowing through the turbine section 13, and to the first and second inner walls 42, 72, which may be heated indirectly by the outer wall 18. As noted above, the turbulator ribs 52, 82 turbulate the flow of cooling fluid so as to increase the amount of cooling provided to the outer wall 18 by the cooling fluid. Once the cooling fluid has traversed substantial radial lengths of the gaps 44, 46, 48, 74, 76, 78, the cooling fluid passes into the leading and trailing edge chambers 56, 86 through the openings 54, 84 in the respective first and second inner walls 42, 72.

The cooling fluid in the leading edge chamber 56 passes through the exit openings 58 in the first inner wall 42 and impinges on the leading edge 20 of the outer wall 18 as it flows into the leading edge channel 60. The cooling fluid in the leading edge channel 60 then provides convective cooling to the leading edge 20 of the outer wall 18 while flowing therethrough and exits the cooling system 40 and the airfoil assembly 10 through the exit passages 62. The cooling fluid exiting the exit passages 62 may provide film cooling to the suction side 26 of the outer wall 18 and is then mixed with the hot working gases and flows with the hot working gases through the remainder of the turbine section 13.

The cooling fluid in the trailing edge chamber 86 passes through the exit openings 88 in the second inner wall 72 and impinges on the pressure and suction sides 24, 26 of the outer wall 18 near the trailing edge 22 as it flows into the trailing edge channel 90. The cooling fluid in the trailing edge channel 90 provides convective cooling to the pressure and suctions sides 24, 26 near the trailing edge 22 of the outer wall 18 and exits the cooling system 40 and the airfoil assembly 10 through the exit passages 92, where the cooling fluid is mixed with the hot working gases and flows with the hot working gases through the remainder of the turbine section 13.

Further, a portion of the cooling fluid in the trailing edge chamber 86 passes through the opening 100 in the inner shroud 16 and into the cavity 102 in the inner shroud 16. From the cavity 102 the cooling fluid is delivered to the cooling circuit 104 in the inner shroud 16 and provides cooling to the structure near the cooling circuit 104. It is noted that a portion of the cooling fluid in the leading edge chamber 56 could pass through a corresponding aperture (not shown) in the inner shroud 16 into the cavity 102 in addition to or instead of the cooling fluid passing from the trailing edge chamber 86 into the cavity 102.

The hot working gases flowing through the turbine section 13 during operation of the engine transfer heat to directly to the outer wall 18, which may indirectly transfer heat to the first and second inner walls 42, 72 so as to increase the temperature of the walls 18, 42, 72. Since the first and second inner walls 42, 72 are structurally isolated from the hot working gases in the turbine section 13, i.e., via the outer wall 18 and the leading and trailing edge gaps 44, 46, 48, 74, 76, 78, the temperatures of the first and second inner walls 42, 74 are not increased as much as the outer wall 18 during operation of the engine, resulting in differing amount of thermal growth between the outer wall 18 and the respective inner walls 42, 72.

Since the outer wall 18 is only affixed to the first inner wall 42 at the single chordal location $L_1$, stress exerted on the outer wall 18 and the first inner wall 42 resulting from differing amounts of thermal growth between the outer wall 18 and the first inner wall 42 is reduced or avoided. That is, if the outer wall 18 were affixed to the first inner wall 42 at multiple chordal locations, thermal growth differences between the outer wall 18 and the first inner wall 42 would result in pushing or pulling between the outer wall 18 and the first inner wall 42 at the multiple affixation locations. Since the outer wall 18 is only affixed to the first inner wall 42 at the single chordal location $L_1$, this pulling or pushing is avoided. Similarly, since the outer wall 18 is only affixed to the second inner wall 72 at the single chordal location $L_2$, stress exerted on the outer wall 18 and the second inner wall 72 resulting from differing amounts of thermal growth between the outer wall 18 and the second inner wall 72 is similarly reduced or avoided.

Further, as noted above, the first and second inner walls 42, 72 are preferably cast integrally with the outer wall 18. This is particularly advantageous with the illustrated airfoil assembly 10, since the vane 12 is curved in the radial direction, see FIG. 1. Since the outer wall 18 is curved, forming the first and second inner walls 42, 72 separately from the outer wall 18 and inserting them into the hollow interior portion 28 could be difficult. However, since the first and second inner walls 42, 72 are cast integrally with the outer wall 18 in the preferred embodiment of the invention, this situation is avoided. While the vane 12 illustrated in FIG. 1 is curved in the radial direction, it is understood that the cooling system 40 described herein need not be used in combination with a vane 12 being curved in the radial direction, such that casting the first and second inner walls 42, 72 integrally with the outer wall 18 is not meant to be a necessary aspect of the invention.

Moreover, cooling of the structure within the airfoil assembly 10 provided by the cooling system 40 described herein is believed to allow for a reduction in the amount of cooling fluid that is provided to the cooling system 40, as compared to prior cooling configurations, while still providing adequate cooling of the structure to be cooled.

Figure 4:
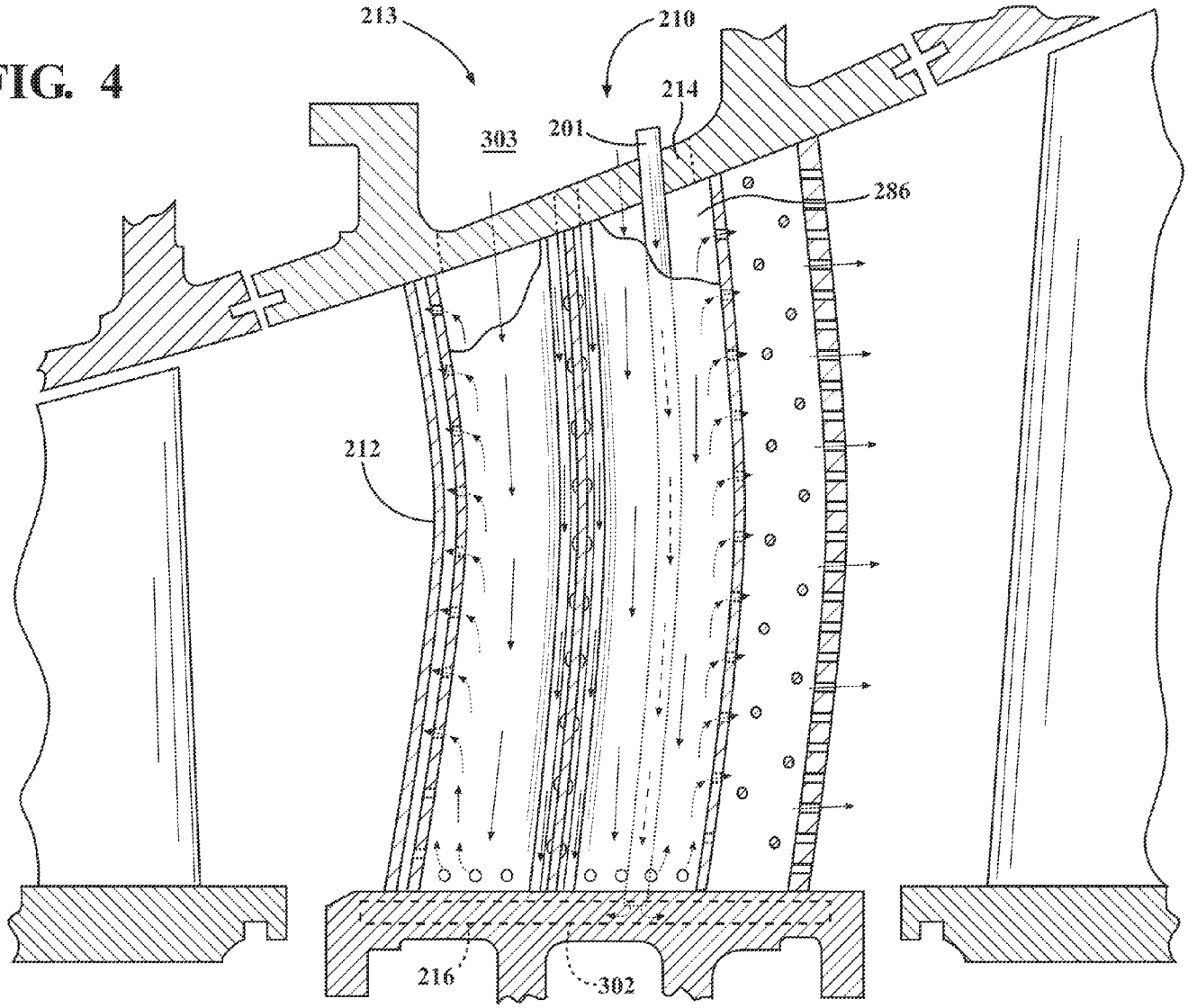
FIG. 4 is a side cut away view of an airfoil assembly to be cooled in a gas turbine engine according to another embodiment of the invention, wherein a suction side of a vane of the airfoil assembly has been removed.

Referring now to FIG. 4, an airfoil assembly 210 associated with a cooling system 240 according to another embodiment is illustrated, where structure similar to that described above with reference to FIGS. 1-3 includes the same reference number increased by 200. In this embodiment, only the structure that is different from that described above with reference to FIGS. 1-3 will be specifically described.

As illustrated in FIG. 4, a conduit 201 extends through a trailing edge chamber 286 from an outer shroud 214 to an inner shroud 216. In this embodiment, no cooling fluid, e.g., compressor discharge air, is provided to a cavity 302 in the inner shroud 216 from the trailing edge chamber 286. Rather the conduit 201 provides cooling fluid directly from a plenum 303 associated with the outer shroud 214 to the cavity 302. Hence, the cooling fluid provided to the cavity 302, which cooling fluid provides cooling to structure located adjacent to a cooling circuit (not shown in this embodiment) within the inner shroud 216, is cooler than in the embodiment described above with reference to FIGS. 1-3, as heat is not transferred to the cooling fluid while passing through trailing edge gaps (not shown in this embodiment) before the cooling fluid is delivered into the cavity 302.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An airfoil in a gas turbine engine comprising:

an outer wall including a leading edge, a trailing edge, a pressure side, and a suction side;

a first inner wall coupled to said outer wall at a single chordal location toward said leading edge, said first inner wall including portions spaced from said pressure and suction sides of said outer wall so as to form first and second leading edge gaps between said first inner wall and said respective pressure and suction sides, said first inner wall defining a leading edge chamber therein and including openings that provide fluid communication between said respective leading edge gaps and said leading edge chamber, said leading edge gaps receiving cooling fluid, wherein the cooling fluid provides cooling to said outer wall as it flows through said leading edge gaps and the cooling fluid, after traversing at least substantial portions of said leading edge gaps, passing into said leading edge chamber through said openings in said first inner wall;

a second inner wall coupled to said outer wall at a single chordal location toward said trailing edge, said second inner wall including portions spaced from said pressure and suction sides of said outer wall so as to form first and second trailing edge gaps between said second inner wall and said respective pressure and suction sides, said second inner wall defining a trailing edge chamber therein and including openings that provide fluid communication between said respective trailing edge gaps and said trailing edge chamber, said trailing edge gaps receiving cooling fluid, wherein the cooling fluid provides cooling to said outer wall as it flows through said trailing edge gaps and the cooling fluid, after traversing at least substantial portions of said trailing edge gaps, passing into said trailing edge chamber through said openings in said second inner wall;

wherein said leading and trailing edge chambers are each in communication with a plurality of exit openings that allow cooling fluid to flow out of said leading and trailing edge chambers; and leading and trailing edge channels adjacent to said respective leading and trailing edge chambers, said leading and trailing edge channels receiving the cooling fluid flowing out of said leading and trailing edge chambers through said exit openings, wherein the cooling fluid in said leading and trailing edge channels provides cooling to said leading and trailing edges of said outer wall.

2. The airfoil according to claim 1, further comprising a rigid spanning structure extending from said pressure side to said suction side and located between said first and second inner walls.

3. The airfoil according to claim 2, wherein a third leading edge gap is formed between said spanning structure and said first inner wall, and a third trailing edge gap is formed between said spanning structure and said second inner wall.

4. The airfoil according to claim 1, wherein said outer wall and said first and second inner walls are each coupled to respective inner and outer shrouds associated with the airfoil.

5. The airfoil according to claim 4, wherein the cooling fluid is provided to said leading and trailing edge gaps through the outer shroud, and at least a portion of the cooling fluid in at least one of said leading and trailing edge chambers is provided into a cavity formed in the inner shroud for providing cooling to the inner shroud.

6. The airfoil according to claim 1, wherein no openings are provided in said outer wall from which cooling fluid in said leading and trailing edge gaps can exit the airfoil.

7. The airfoil according to claim 1, further comprising a plurality of spacer members between said outer wall and each of said first and second inner walls, each of said spacer members spacing said outer wall from one of said first and second inner walls and permitting relative movement between said outer wall and said first and second inner walls.

8. An airfoil in a gas turbine engine comprising:

an outer wall including a leading edge, a trailing edge opposed from said leading edge in a chordal direction, a pressure side, and a suction side;

an inner wall coupled to said outer wall at a single chordal location, said inner wall including portions spaced from said pressure and suction sides of said outer wall so as to form first and second gaps between said inner wall and said respective pressure and suction sides, said inner wall defining a chamber therein and including openings at only a radially inner portion of said inner wall, said openings providing fluid communication between said respective gaps and said chamber, said gaps receiving cooling fluid, wherein the cooling fluid provides cooling to said outer wall as it flows through said gaps and the cooling fluid, after traversing at least substantial portions of said gaps, passing into said chamber through said openings in said inner wall.

9. The airfoil according to claim 8, wherein said chamber is in communication with a plurality of exit openings that allow cooling fluid to flow out of said chamber.

10. The airfoil according to claim 9, further comprising a channel adjacent to said chamber, said channel receiving the cooling fluid flowing out of said chamber through said exit openings, wherein the cooling fluid in said channel provides cooling to one of said leading and trailing edges of said outer wall.

11. The airfoil according to claim 8, wherein no openings are provided in said outer wall from which cooling fluid in said gaps can exit the airfoil.

12. The airfoil according to claim 8, wherein at least one of said outer wall and said inner wall includes a plurality of spacer members for spacing said outer wall from said inner wall, said spacer members permitting relative movement between said outer wall and said inner wall.

13. An airfoil assembly in a gas turbine engine comprising:

an inner shroud;

an outer shroud spaced from said inner shroud in a radial direction of the engine; and an airfoil between said inner and outer shrouds, said airfoil comprising:

an outer wall coupled to said inner shroud and to said outer shroud, said outer wall including a leading edge, a trailing edge opposed from said leading edge in a chordal direction, a pressure side, a suction side, an outer edge affixed to said outer shroud, and an inner edge affixed to said inner shroud;

a first inner wall coupled to said inner shroud and to said outer shroud, said first inner wall coupled to said outer wall at a single chordal location toward said leading edge, said first inner wall including portions spaced from said pressure and suction sides of said outer wall so as to form first and second leading edge gaps between said first inner wall and said respective pressure and suction sides, said leading edge gaps receiving cooling fluid directly from said outer shroud, wherein the cooling fluid provides cooling to said outer wall as it flows through said leading edge gaps; and a second inner wall coupled to said inner shroud and to said outer shroud, said second inner wall coupled to said outer wall at a single chordal location toward said trailing edge, said second inner wall including portions spaced from said pressure and suction sides of said outer wall so as to form first and second trailing edge gaps between said second inner wall and said respective pressure and suction sides, said trailing edge gaps receiving cooling fluid directly from said outer shroud, wherein the cooling fluid provides cooling to said outer wall as it flows through said trailing edge gaps.

14. The airfoil assembly according to claim 13, further comprising a rigid spanning member extending from said pressure side to said suction side and located between said first and second inner walls, wherein a third leading edge gap is formed between said spanning structure and said first inner wall and a third trailing edge gap is formed between said spanning structure and said second inner wall.

15. The airfoil assembly according to claim 13, wherein:

said first inner wall defines a leading edge chamber therein and includes openings that provide fluid communication between said respective leading edge gaps and said leading edge chamber, and the cooling fluid, after traversing at least substantial portions of said leading edge gaps, passes into said leading edge chamber through said openings in said first inner wall; and said second inner wall defines a trailing edge chamber therein and includes openings that provide fluid communication between said respective trailing edge gaps and said trailing edge chamber, and the cooling fluid, after traversing at least substantial portions of said trailing edge gaps, passes into said trailing edge chamber through said openings in said second inner wall.

16. The airfoil assembly according to claim 15, wherein:

said leading and trailing edge chambers are in communication with a plurality of exit openings that allow cooling fluid to flow out of said leading and trailing edge chambers;

said airfoil further comprises leading and trailing edge channels adjacent to said respective leading and trailing edge chambers, said leading and trailing edge channels receiving the cooling fluid flowing out of said leading and trailing edge chambers through said exit openings; and the cooling fluid in said leading and trailing edge channels provides cooling to said leading and trailing edges of said outer wall.

17. The airfoil assembly according to claim 15, wherein at least a portion of the cooling fluid in said trailing edge chamber is provided into a cavity formed in said inner shroud for providing cooling to said inner shroud.

* * * * *